US005863235A

United States Patent [19]

Bendik, Jr. et al.

[11] Patent Number: 5,863,235

[45] Date of Patent: Jan. 26, 1999

[54] SPINNING/ROLLING DISC

[76] Inventors: Joseph John Bendik, Jr., 1001 East Evelyn Ter., #149, Sunnyvale, Calif. 94086; Laurence Jay Shaw, 338 Third Ave., #1, San Francisco, Calif. 94118; Richard Henry Wyles, 4522-A Foothill Rd., Carpinteria, Calif. 93013

[21] Appl. No.: 857,805

[22] Filed: May 16, 1997

Related U.S. Application Data

[63] Continuation-in-part of Ser. No. 686,003, Jul. 25, 1996, abandoned.

[51] Int. Cl.[6] ..... A63H 33/22

[52] U.S. Cl. ..... 446/219; 446/243

[58] Field of Search ..... 446/8, 10, 219, 446/236, 243, 244, 256, 259

[56] References Cited

U.S. PATENT DOCUMENTS

| | | | |
|---|---|---|---|
| 4,076,252 | 2/1978 | Bernier et al. | 446/256 X |
| 5,200,253 | 4/1993 | Yamaguchi et al. | 446/219 UX |
| 5,514,021 | 5/1996 | Sugawara | 446/10 |

OTHER PUBLICATIONS

Packaging for Eccentrix Diffraction Disk, manufactured by Lightrix, Inc. or South San Francisco, California. Copyright 1994.

*Primary Examiner*—John A. Ricci
*Attorney, Agent, or Firm*—Laurence J. Shaw

[57] ABSTRACT

A cylindrical metal disc is optimized to spin/roll on a base for an extended length of time, and as the angle of inclination of the disc decreases to zero, a tone emitted by the spinning/rolling of the disc rises in pitch towards infinity. To optimize the spinning/rolling time, the radius-to-height aspect ratio of the disc is approximately three, the upper surface of the base and the lower edge of the disc are smooth and hard to enable the disc to spin/roll for an extended length of time, and the base has three legs and is solidly constructed to minimize energy losses due to vibration. The upper surface of the base is concave to prevent the disc from wandering as it spins/rolls. The top of the disc is tessellated with tiles having effectively random optic orientations to produce the appearance of a cloud of sparkling lights in the vicinity of the top surface of the disc as it spins/rolls.

7 Claims, 4 Drawing Sheets

SPINNING/ROLLING DISC

RELATED DOCUMENTS

This application is a continuation in part of application Ser. No. 08-686,003, filed Jul. 25, 1996, now abandoned.

The present patent application is related to Disclosure Document No. 365,830 filed Nov. 25, 1994.

BACKGROUND OF THE INVENTION

Spinning objects, such as tops and gyroscopes, have been popular toys for centuries. Because the position and orientation of a spinning object changes slowly so that the outline of the toy appears stationary, while the surface of the object generally moves faster than the eye can resolve, such toys have an intriguing appearance. The visual appeal of such toys is compounded by the fact that well-designed tops and gyroscopes spin for long periods of time.

It is a commonly observed phenomena that when a coin is rolled on a flat horizontal surface, the path of its contact with the horizontal surface will be a spiral of decreasing radius. As the radius of the spiral approaches the radius of the coin, the rolling motion appears to become a spinning motion. As the coin loses energy to friction/vibration during its spinning/rolling, the angle of inclination of the coin approaches zero.

Similarly, if the coin is spun on a horizontal surface about a vertical axis orthogonal to the axis of cylindrical symmetry of the coin, as the coin loses energy to friction/vibration its angle of inclination again approaches zero, and its path on the horizontal surface describes a spiral with a radius that increases towards the radius of the coin. In the present specification the motion of the coin when the radius of the spiral path is on the order of the radius of the coin will be termed "spolling," and the radius of the near-circular path of contact between the coin and the surface on which it spolls will be termed the "radius of spolling."

A recently developed amusement device based on the spolling motion of coins is the Spin Bank™, distributed by WACO Products Corporation of Pine Brook, N.J. As shown in FIG. 1, the Spin Bank (5) has roughly an hour-glass shape. At the top surface (10) of the Spin Bank (5) is a slot (15) through which a coin (20) may be inserted. The slot (15) has a pair of spring-biased metal plates (17) projecting therein, and insertion of the lower half of the coin (20) through the slot (15) forces the plates (17) to separate. Then, as the upper half of the coin (120) passes through the slot, the plates (17) move towards each other due to the biasing of the springs (not shown). The front edges (18) of the plates (17) are parallel to each other and at an oblique angle to the longitudinal axis of the slot (15), so a rotation about a vertical axis is imparted to the coin (20) when it is ejected from the slot (15) by the spring-biased metal plates (17).

A concave mirrored platform (30) with a diameter of approximately 1¼ inches is located at the center plane of the Spin Bank (5) (i.e., where it narrows in width), and when the coin (20) impacts the concave platform (30) it spolls. Often a transverse momentum is imparted to the coin (20), causing the coin (20) to roll off of the concave platform (30). However, if a transverse momentum is not imparted to the coin (20) it will spoll until the radius of the spiral path of contact between the coin (20) and the platform (30) becomes just greater than the radius of the platform (30), at which point the coin (20) will fall from the platform (30). It should be noted that only the initial portion of the spolling of the coin (20) is generally displayed, because the coin (20) usually falls off the platform (30) before its angle of inclination with the horizontal plane becomes small. Because the edges of coins generally have nicks and scratches, and in some cases are serrated (as in the case of the United States ten and twenty-five cent pieces), and because the platform (30) is not especially smooth, energy is lost to friction/vibration fairly rapidly so the spolling motion only lasts a few seconds.

It is therefore an object of the present invention to provide a disc which will spin/roll (i.e., "spoll") on a base for an extended length of time.

It is another object of the present invention to provide a base on which a disc can spin/roll for an extended length of time.

It is another object of the present invention to minimize the energy loss due to friction/vibration of a disc which spins/rolls on a base.

It is another object of the present invention to provide a disc which will reach an angle of low inclination while spolling on a base.

It is therefore another object of the present invention to provide a disc with an edge which minimizes the energy loss due to friction/vibration as the disc spins/rolls on a base.

It is another object of the present invention to enhance the visual effect of the spinning/rolling of a disc on a base.

It is another object of the present invention to provide a base which is relatively immobile as a disc spins/rolls on it.

It is another object of the present invention to provide a base on which a disc can spin/roll without falling off the base.

It is another object of the present invention to provide a disc which will spoll on a base, emitting a tone which rises with pitch as the angle of inclination of the disc becomes low.

The present invention is directed to toy which includes a disc and a base. The disc has a smooth lower edge, the base has a smooth concave upper surface, such that the disc spolls on the base for an extended period of time.

The present invention is also directed to a toy which includes a disc with a smooth lower edge and a base with a concave upper surface. The upper surface of the disc has a tessalated reflective surface, the effective angles of optical orientation of the tiles of the tessalated reflective surface being effectively random.

DETAILED DESCRIPTION OF THE PRESENT INVENTION

A simple cylindrical disc can be made to spin in a fashion similar to that of a top by causing it to roll in a circle of a diameter approximately equal to the diameter of the disc. However, if spun on a flat surface, the location of the near-circular path of contact between the disc and base may tend to wander, and the spinning disc will not appear to have a stationary outline or any sort of symmetry. Unless optimized as described below, frictional/vibrational forces will severely limit the spinning time of the disc.

Figure 1:
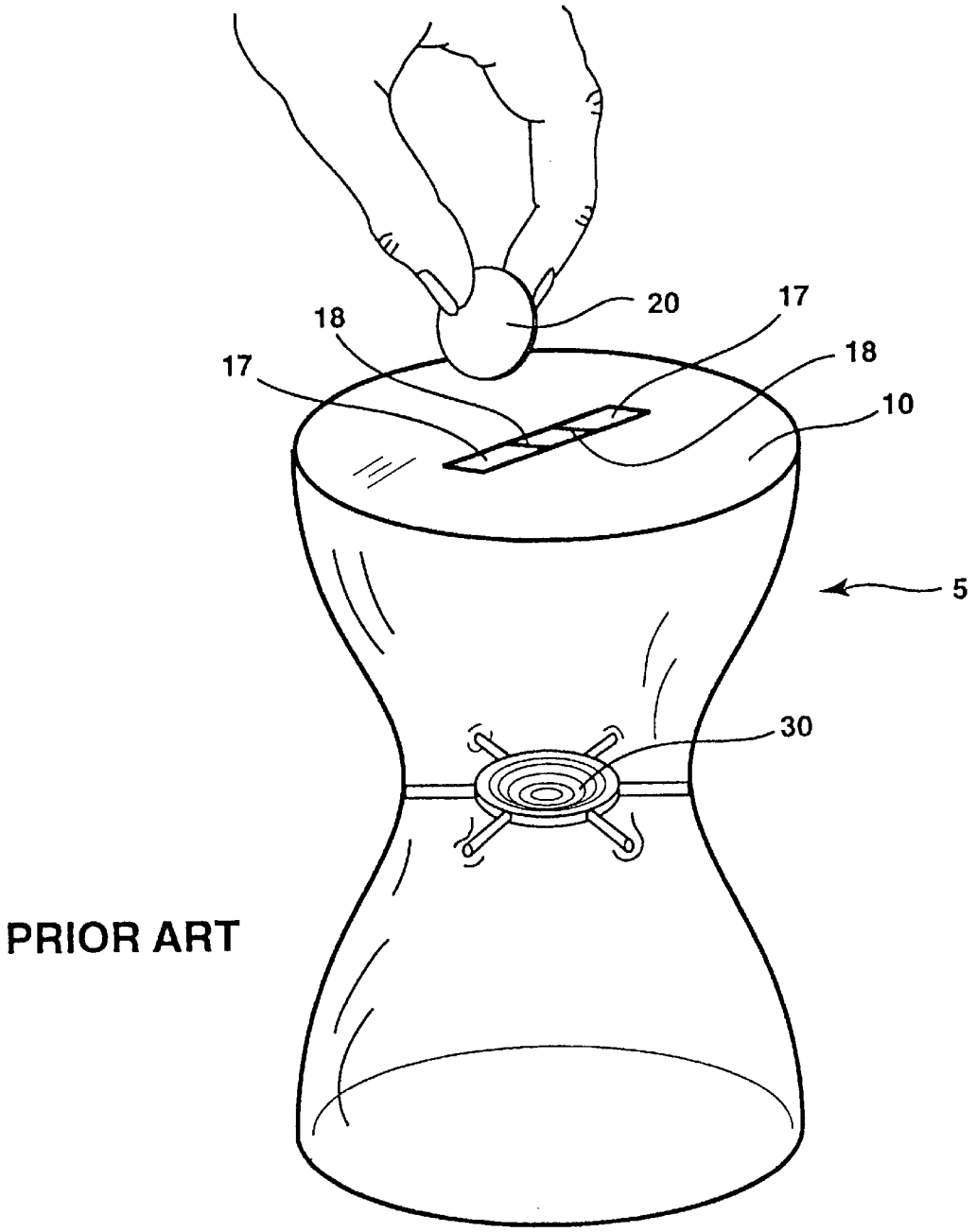
FIG. 1 shows a prior art amusement device which includes a platform on which a coin is made to spin/roll.
Figure 2:
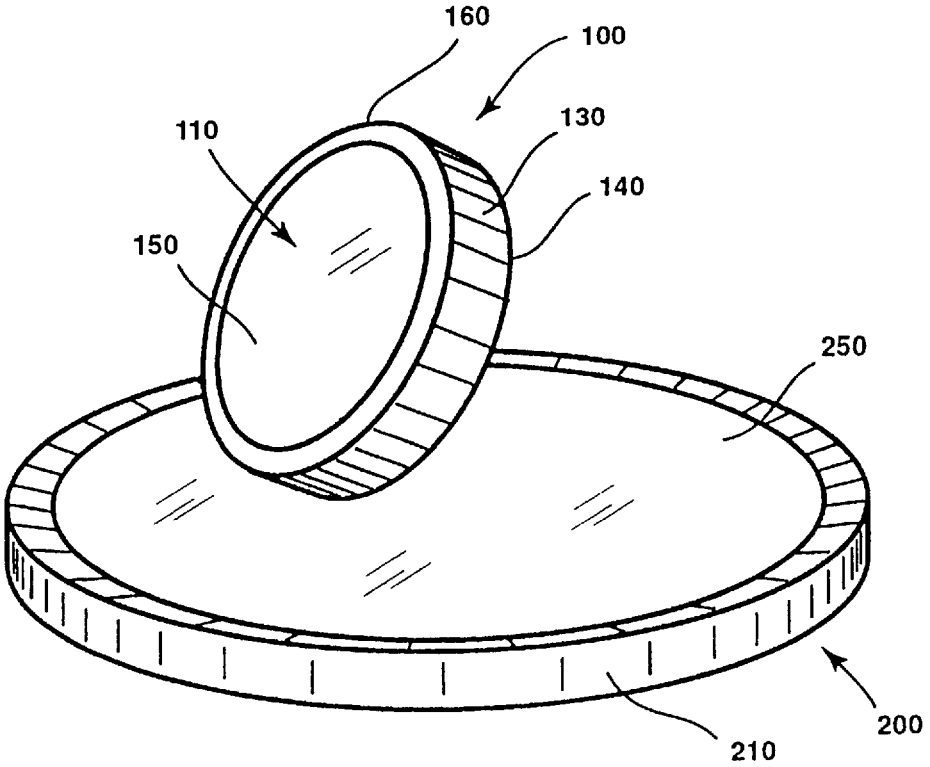
FIG. 2 shows a perspective view of the toy of the present invention.
Figure 3:
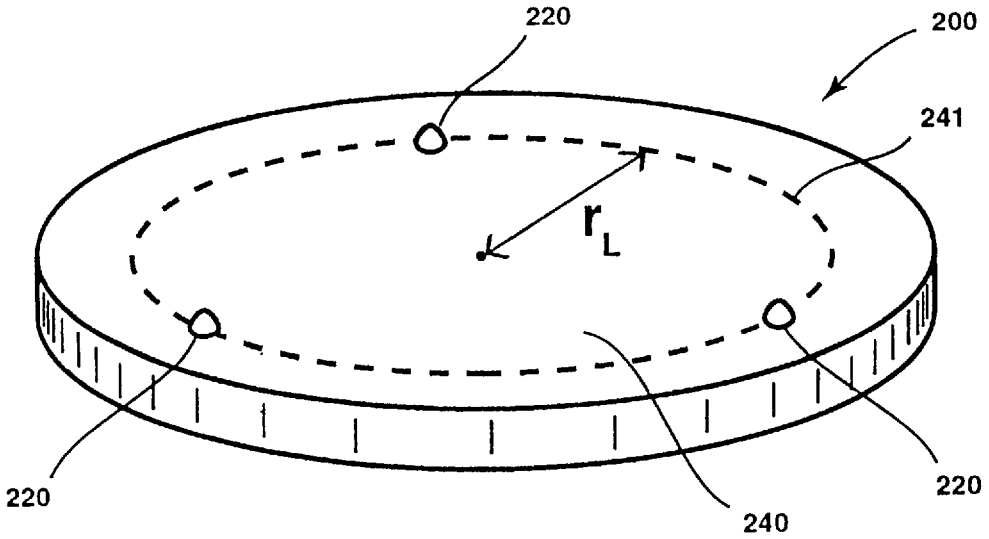
FIG. 3 shows a perspective view of the bottom of the base of the toy of the present invention.
Figure 4:
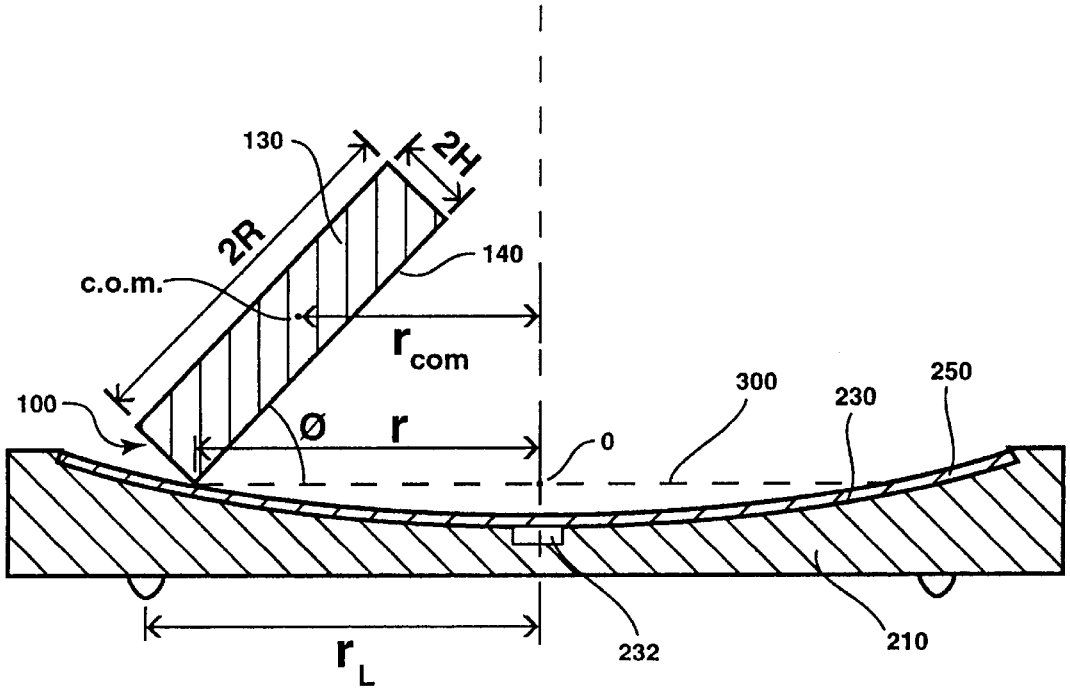
FIG. 4 is a cross-sectional diagram of the disc and base of the toy of the present invention.

The preferred embodiment of the disc (100) and base (200) of the present invention is shown in perspective in FIG. 2, and in cross-section in FIG. 3. The disc (100) is substantially cylindrical with an upper surface (150), a lower surface (not visible in FIG. 2), a side face (130), a top, edge (160), and a bottom edge (140). The disc (100) shown in FIG. 4 is oriented so that the bottom face of the disc (100) is at an angle $\phi$ relative to the horizontal plane (300).

The disc (100) is preferrably made of a hard, heavy material such as a metal. The disc (100) may be manufactured from metal by means such as machining, stamping, forging, or molding. In the preferred embodiment the metal is stainless steel, since stainless steel provides the advantages that it does not oxidize and is relatively hard. However, if made of a metal such as steel which is susceptible to oxidation, at least the lower edge of the disc (100) is coated or plated to prevent oxidation. Depending on the type of plating or coating process used, the defects in the smoothness of the lower edge of the disc (100) may be enlarged or reduced in size.

The upper surface (150) of the disc (100) has a radius of R, and the side face (130) has a height of 2 H. Emperically, it is found that a large radius-to-height (R:H) aspect ratio produces a disc (100) which spolls relatively slowly for a given angle $\phi$. In addition, a disc (100) with a large radius-to-height (R:H) aspect ratio spolls for a relatively long period of time. Conversely, a small radius-to-height (R:H) aspect ratio produces a disc (100) which spolls more rapidly for a given angle $\phi$. In addition, a disc (100) with a small radius-to-height (R:H) aspect ratio spolls for a shorter period of time. As a compromise between an extended spolling time and a rapid rate of rotation, preferred embodiments have a radius-to-height ratio between 2 and 6, more preferrably between 2.5 and 4, and most preferrably approximately 3. For instance, in one preferred embodiment the disc (100) has a height of ½" and a radius of approximately 1.5', and therefore a radius-to-height aspect ratio of 3.

The bottom edge (140) of the disc (100) is polished, or made smooth by some other means, to reduce the rate of energy loss to friction/vibration, thereby increasing the spolling time of the disc (100). In the preferred embodiment the bottom edge (140) is polished to a finish less than fourteen millionths of an inch (arithmetic average deviation of surface irregularities from a perfect plane), more preferrably less than twelve millionths of an inch, still more preferrably less than ten millionths of an inch, still more preferrably less than eight millionths of an inch, even more preferrably less than six millionths of an inch, and even more preferrably less than four millionths of an inch.

It has been found that as the sharpness of the bottom edge (140) increased (i.e., the radius of curvature of the bottom edge (140) is reduced), the loss of energy to friction/vibration becomes increasingly sensitive to the smoothness of the bottom edge (140) and the smoothness of the upper concave surface (250) of the base (200). Therefore, if the radius of curvature is made too small then the surface of the bottom edge (140) is too easily damaged, and small imperfections in the polish and small particles of dirt and dust on the base (200) can significantly reduce the spolling time of the disc (100). However, it has been found empirically that as the radius of curvature of the bottom edge (140) of the disc (100) is increased, the wandering of the center of the near-circular path of contact between disc (100) and base (200) tends to increase. Therefore, the radius of curvature of the bottom edge (140) of the disc (100) cannot be made too large or else the center of the path of contact between the disc (100) and the base (200) tends to wander. This is particularly an issue when the upper surface (250) of the base (200) is not sufficiently concave, since then it becomes more likely that the disc (100) will roll off the base (200). Another disadvantage of a large radius of curvature of the bottom edge (140) is that the bottom edge has a greater amount of area that must be made smooth, therefore increasing the manufacturing expense. Empirically, it is found that the optimum ratio of the radius R of the upper surface (150) of the disc (100) to the radius of curvature of the bottom edge (140) is preferrably greater than 6 and less than 192, more preferrably greater than 16 and less than 96, and most preferrably approximately 32. Therefore, where the disc (100) has a radius R of 3", the bottom edge (140) preferrably has a radius of curvature greater than 1/64" and less than ½", more preferrably greater than 1/32" and 3/16", and most preferrably the radius of curvature is approximately 3/32".

A diagrammatic side view of the disc (100) on the base (200) is shown in FIG. 4. If the loss of energy to friction/vibration per revolution of the disc (100) is small compared to the sum of the kinetic and potential energy, the relation between the velocity v of the point of contact of the disc (100) and the base (200), the radius r of spolling (i.e., the radius of the path of the point of contact between the disc (100) and the base (200)), and the angle $\phi$ between the normal vector of the disc and the base can be determined by assuming a constant energy state (with the path of the contact between the disc (100) and the base (200) being circular). It should be noted that for simplicity in FIG. 4 and the following calculation, the lower edge 140 of the disc is not considered to be rounded.

The upwards force $F_u$ on the edge of a spolling disc of mass M, radius R and height 2 H is equal to Mg. The inwards force $F_i$ necessary to cause the circular motion of the center of mass (abbreviated as "com") is $F_i=M\omega^2 r_{com}=M(v/r)^2(r-R\cos\phi+H\sin\phi)$, where $\omega$ is the angular velocity of the center of mass in the frame of reference of the base (200), and $r_{com}$ is the horizontal distance from the center of mass (corn) of the disc (100) to the center (O) of the path of the point of contact.

The relation between the time derivative of the angular momentum L in the inertial frame of the base (200) and in the rotating frame of the center of the disc (100) is given by $dL/dt=L'+\omega\times L$, where the prime indicates a time derivative in the rotating frame, and $\omega$ is the angular velocity of the rotating frame (see page 233 of Grant R. Fowles, *Analytical Mechanics,* Third Edition, Holt, Rinehart & Winston, N.Y., 1977). In this case $L'=0$, because we have assumed a constant energy state where the rate of rotation of the disc about its center is constant. The moment of inertia for the disc is $M(R^2/2)$ and the angular velocity of the disc is $(v/R)$, so $L=(v/R)M(R^2/2)=MRv/2$, and since $\omega=v/r$, $|dL/dt|=|\omega\times L|=Mv^2R\sin\phi/2r$.

The torques produced by the upwards force $F_u$ and the inwards force $F_i$ causes the change in angular momentum of the disc (100). By a fundamental theorem of angular momentum (see pages 201–203 of Fowles) the time rate of change of angular momentum about the center of mass is equal to the total moment of the external forces about the center of mass. The torque due to the upwards force is given by $$Mg\,(R^2+H^2)^{1/2}\sin(90-\phi-\tan^{-1}(H/R)) = Mg\,(R^2+H^2)^{-1/2}[\sin(90-\phi)\cos(\tan^{-1}(H/R))) - \cos(90-\phi)\sin(\tan^{-1}(H/R)))$$
$$= Mg\,(R^2+H^2)^{1/2}(R^2+H^2)^{1/2}[R\cos\phi - H\sin\phi]$$
$$= Mg[R\cos\phi - H\sin\phi]$$

The torque due to the inwards force is given by $$M\,(v/r)^2(r-R\cos\phi+H\sin\phi)\,(R^2+H^2)^{1/2}\sin(\phi+\tan^{-1}(H/R)) = M\,(v/r)^2(r-R\cos\phi+H\sin\phi)\,(R^2+H^2)^{1/2}(R^2+H^2)^{-1/2}[R\sin\phi+H\cos\phi]$$
$$= M\,(v/r)^2(r-R\cos\phi+H\sin\phi)[R\sin\phi+H\cos\phi].$$

Equating the vector sum of the torques with the time derivative of the angular momentum provides $v^2R/2r=g(R\cot\phi-H)-(v/r)^2(r-R\cos\phi+H\sin\phi)(R+H\cot\phi)$. Solving for the velocity v provides $r/2=(gr^2/v^2)(\cot\phi-(H/R))-(r-R\cos\phi+H\sin\phi)(1+(H/R)\cot\phi)$, or $r/2+(r-R\cos\phi+H\sin\phi)(1+(H/R)\cot\phi)=(gr^2/v^2)\{\cot\phi-(H/R)\}$ or finally $v=r[g\{\cot\phi-(H/R)\}]^{1/2}[r/2+(r-R\cos\phi+H\sin\phi)(1+(H/R)\cot\phi)]^{-1/2}$. In terms of the dimensionless quantities h and ρ defined as $h=H/R$ and $\rho=r/R$ this becomes $v=R^{1/2}\rho[g\{\cot\phi-h\}]^{1/2}[\rho/2+(\rho-\cos\phi+h\sin\phi)(1+h\cot\phi)]^{-1/2}$ For simplicity of analysis, consider the special case where the disc (100) is infinitely thin (H=0). Then the velocity of the point of contact is given by $v=R^{1/2}\rho[g\cot\phi]^{1/2}/[3\rho/2-\cos\phi]^{1/2}$. It should be noted that although the denominator is a difference, it cannot go to zero and cause a divergence of the velocity since it is always true that $R\cos\phi<r$, i.e., the center of mass (com) of the disc (100) is located between the center of the path of contact of radius r and the point where the disc (100) touches the base (200). As expected since the sound emitted by the spolling disc (100) rises rapidly in pitch as the angle φ goes to zero, the velocity v of the point of contact diverges as the angle φ goes to zero due to the factor of $[\cot\phi]^{1/2}$. In particular, v diverges as the inverse of the square root of φ as $\phi\to 0$.

It may also be noted that the angular velocity Ω at which the infinitely thin disc (100) appears to rotate as it spolls (which is best observed by putting an easily visible marking on the outer edge of the disc and noting its rate of rotation) is given by $\Omega=2\pi(1-(r/R))(v/r)=2\pi(1-(r/R))[g\cot\phi/3r/2-R\cos\phi]^{1/2}$. Although the relationship $R\cos\phi<r$ must hold, as mentioned above, the radius R of the disc (100) may be greater than the radius r of spolling, so that the factor (1−(r/R)) may have a positive or negative sign and the disc (100) may appear to rotate in the same direction that it spolls or in the opposite direction.

As shown in the perspective view of FIG. 2 and the cross-sectional view of FIG. 4, the base (200) is constructed of a magnifying mirror (250) which is glued into a plastic or metal frame (210). The view of the bottom of the disc (100) provided by the mirror (250) enhances the visual effect of the spolling. Preferrably the diameter of the mirror (250) should be greater than the diameter of the disc (100), more preferrably the diameter of the mirror (250) should be greater than 1.5 times the diameter of the disc (100), and most preferrably the diameter of the mirror (250) should be greater than twice the diameter of the disc (100). If the mirror (250) is not sufficiently concave, the center of the path of contact between the disc (100) and the base (200) will tend to wander and the disc (100) is likely to roll off the base (200). However, if the mirror (250) has too much curvature, the spolling motion will be too greatly affected by the distance of the disc (100) from the lowest point on the mirror (250). Preferrably the radius of curvature of the mirror (250) is between 30 inches and 80 inches, more preferrably between 40 inches and 70 inches, and most preferrably approximately 50 to 60 inches. In the preferred embodiment, the mirror (250) is a cosmetics mirror with a diameter of approximately 8 inches.

The top contour of the frame (210) closely matches the bottom contour of the mirror (250), and a uniform layer of glue (230) is deposited therebetween. If too much glue (232) is used, glue (232) will tend to ooze out from the space between exterior edge of the mirror (250) and the frame (210), making the appearance of the base (200) unattractive. If too little glue (232) is used the bond between the mirror (250) and the frame (210) will not be sufficiently strong, and energy losses due to vibration will be high. A cylindrical cavity (232) centered on the top surface of the frame (210), and circular grooves (not shown) concentric with the reservoir (232) provide increased variability in the amount of glue (230) that may be applied in the gluing process. The length of the spolling time and the sound produced by the disc (100) as it spolls on the base (200) is affected by the type and amount of glue (230) affixing the mirror (250) to the frame (210). Preferrably the glue (230) is rigid and is applied to the entire area of contact between the mirror (250) and the frame (210). The more rigid types of glues are less lossy, thereby lengthening the spolling time. When the glue (230) fills the region between the mirror (250) and the frame (210), the sound produced by the spolling of the disc (100) is a "solid" sound with a strong fundamental. It should be noted that, should the disc (100) or some other heavy object be dropped on the mirror (250) causing it to break, shards of the mirror (250) are less likely to fly off when glue (230) covers the entire area of contact between the mirror (250) and the frame (210). With air gaps between the mirror (250) and frame (210) the sound produced by the spolling of the disc (100) is a more "tinny" sound having more overtones, and the spolling time of the disc (100) is reduced by to losses due to friction/vibration. It should be noted that the glue (230) can somewhat affect the radius of curvature of the mirror (250), and distortions in the upper surface of the mirror (250) caused by glue (230) will reduce the spolling time of the disc (100) and are therefore to be avoided.

A smooth upper surface of the mirror (250) becomes easier to fabricate as the thickness of the mirror glass decreases. However, the glass of the mirror (250) must not be too thin, or else the mirror (250) is likely to crack due to the fracture stress applied by the edge of the disc (100). The approximate relation between the minimum thickness T of the mirror glass and the weight W of the disc (100) is given by (see *Photonics Rules of Thumb,* Miller and Friedman, McGraw Hill)

$$T = \frac{D^2}{4\,[8\pi\sigma/3W(x+\nu)S]^{1/2}},$$

where D is the characteristic diameter of the contact area between the disc (100) and the mirror (250), σ is the worst case fracture stress for glass, x is a factor reflecting the geometry of the support structure for the mirror (250) over the area of contact, ν is Poisson's ratio for glass, and S is a safety factor. The worst case fracture stress for glass is approximately 500 pounds per square inch, Poisson's ratio for glass is approximately 0.3, the geometric factor x for glass which is glued to a hard surface is between 1 and 3 (a value of 3 is appropriate when the glass is clamped at the edges of the contact area, and a value of 1 is appropriate when a planar support is placed below the area of contact), and the safety factor is generally assigned a value between 1 and 20. By coating the edge of the disc (100) of the preferred embodiment with ink, putting it in contact with the mirror (250), and measuring the size of the resulting ink spot on the mirror (250), it is determined that the characteristic diameter of the area of contact is approximately 0.025 inches. Since the disc (100) of the preferred embodiment weighs approximately 1 pound, for a safety factor of unity and a geometric factor x of 1 it is determined that the thickness of the glass must be at least 0.066 inches. Preferrably, the thickness of the mirror glass is greater than T and less than 20 T, more preferrably the thickness of the mirror glass is greater than T and less than 10 T, even more preferrably the thickness of the mirror glass is greater than T and less than 5 T, and most preferrably the thickness of the mirror glass is greater than T and less than 3 T.

The bottom of the base (200) is shown in perspective in FIG. 3. Extending from the bottom surface (240) of the base (200) are three legs (220) arranged in an equilateral triangle on a circle (241) with a radius $r_L$ of approximately 4.5 inches. Since three points define a plane, the three points of contact provided by the legs (220) of the base (200) on the surface on which the base (200) is placed insures that the base (200) maintains a stable position, even on a relatively rough surface. Each leg (220) has a length of approximately ⅛ inch, and each leg (220) has a diameter at the tip of less than 1/16 inch to insure that the leg essentially acts as a point contact.

It is crucial that the legs (220) be located far enough from the center of the base (200) and the mass of the base (200) be large enough to avoid tipping of the base (200) as the disc (100) spolls, since this would substantially reduce the spolling time of the disc (100). If the base (200) has a mass of $M_b$, and the disc (100) has a mass of $M_d$, the path of contact of the disc (100) with the base (200) is a circle of radius $r_c$, the base (200) will tip if $M_d(r_c-r_L/2)>M_b r_L/2$.

A circular decal (150) is mounted on the top surface (110) of the disc (100). Preferrably, the decal (150) has a radius which is between 1/16" and ¼" less than the radius of the disc (100) to facilitate easy mounting of the decal (150) on the disc (100). In the preferred embodiment the decal (150) has a diameter of 2.5" and is tessellated with tiles (not shown) having characteristic widths of about 1/20 inch. Each tile is a holographic interference pattern. Therefore, a beam of white light incident on a tile is reflected as a multiplicity of colored beams. The optical orientations of the tiles are effectively random so that at any given orientation of the decal (150), the light from any of the incident light sources is directly reflected to the eye from an effectively random selection of tesserae. In the preferred embodiment the decal (150) is a Diffracto-Lite®, Holographic Glitter or Sequins sticker manufactured by Coburn Corporation of Lakewood, N.J., and the light source is a halogen light.

Figure 5:
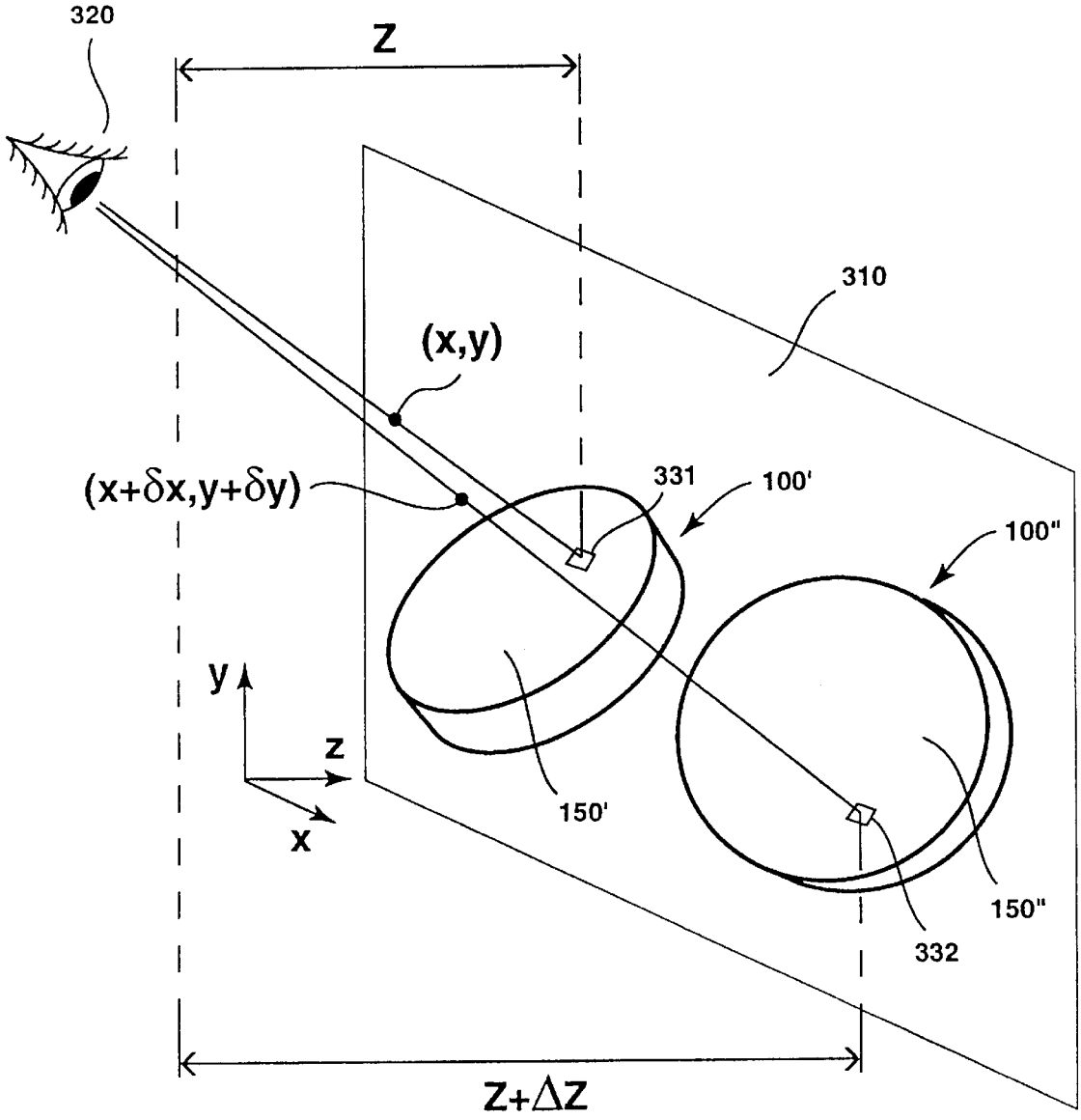
FIG. 5 shows the light rays reflected to the eye of a viewer from a spolling disc at two locations and orientations.

As illustrated by FIG. 5, when the disc (100', 100") is spolling the orientation of the decal (150', 150") is continually changing, and the irregularly-placed colored reflections gives the dramatic appearance of a cloud of flashing colored specks of light. This is because a first tile (331) might reflect light to the eye (320) of a viewer at a position (x, y) on the viewer's visual plane (310) at a distance z from the viewer when the disk (100') is at a first position along its spolling path, and a second tile (332) might reflect light to the eye (320) of a viewer at a position (x+δx, y+δy) on the viewer's visual plane at a distance z+Δz from the viewer when the disk (100") is at a second position along its spolling path, where δx and δy are small but Δz is not (i.e., Δz>>δx and Δz>>δy).

The present invention has been described in terms of a preferred embodiment. However, it should be understood that the invention is not limited to the preferred embodiments described above, and other variations are to be considered within the scope of the invention. For instance, the metal "disc" need not be cylindrical or have cylindrical symmetry, and the bottom edge of the "disc" need not be circular, since objects of other shapes can be made to spoll. (It should however be noted that a central bore in the "disc" tends to increase the wandering of the center of the path of contact between the disc and the base.)

Furthermore, the description of the physical principles underlying the operation and performance of the present invention are also presented for purposes of illustration and description, and are not intended to be exhaustive or limiting. It should be understood that these descriptions include many approximations, simplifications and assumptions to present the basic concepts in a mathematically tractable form, and many effects which influence the operation and performance are neglected for ease of presentation.

Other variations within the scope of the invention include: the bottom edge of the disc may have a periodic pattern of ridges or grooves so that it will emit a pitch while spolling; the top surface of the disc may have a number of protruding elements; the base may be manufactured to have a resonant chamber or some other means for amplifying the tone produced by the spolling disc; the base need not have legs; the base may have an integrally formed system of struts or ribbings to provide additional rigidity; the base may have more than three or less than three legs; the top edge of the disc need not be rounded; the bottom surface of the disc may also have a decal for reflecting light at many different angles; the top surface of the disc need not have tiles with randomly oriented optic angles; the means for reflecting light from the top surface of the disc need not be a decal and may, for instance, be etched directly into the surface of the disc; the reflecting decal may be of any size; the reflecting decal need not be circular; the reflecting tiles need not be holographic, and could instead by simply randomly oriented mirror surfaces; the sound emitted by the spolling disc may be used as a timing source, for instance for a strobe light timed to enhance the visual effect; the radius-to-height aspect ratio may have other values; the radius of curvature of the bottom edge of the disc may be greater than or less than described above; the legs on the base may be closer or farther apart than described; the finish on the bottom edge may differ from that described; the top surface of the base need not be mirrored; the base may be integrally constructed of a material such as glass, metal or plastic; the disc need not be made of metal, or if made of metal it need not be made of stainless steel; reflective stickers and the disc may be magnetic so that the stickers are removably attachable to the disc; the side surface of the disc may also be tessalated with terrerae with effectively random optic orientations; both the top and bottom edges of the disk may be rounded, so the disk will spoll for an extended period on either on the top edge or the bottom edge; etc.

What is claimed is:

1. An amusement device comprising:

a base having an upper surface which is concave and smooth;

a spolling object having a circular lower edge and a reflective upper surface, said reflective upper surface being tessellated with a plurality of tiles having effectively random optical orientations, such that as said object spolls, light reflected from said tiles on said reflective upper surface has an appearance of a three-dimensional volume of sparkling light.

2. The amusement device of claim 1 wherein said reflective upper surface is a planar surface.

3. The amusement device of claim 2 wherein said reflective upper surface is provided by a holographic sticker.

4. The amusement device of claim 1 wherein a first tile has a first optic axis with a first orientation relative to said reflective upper surface such that it reflects light to the eye of a viewer at a first position (x, y) on a visual plane of said viewer at a first distance z from said viewer while said spotting object is spolling, and a second tile has a second optic axis with a second orientation relative to said reflective upper surface such that it reflects light to the eye of said viewer at a second position ($x+\delta x$, $y+\delta y$) on said visual plane of said viewer at a second distance $z+\Delta z$ from said viewer while said spolling object is spolling, where said first orientation is separated from said second orientation by a large enough angle that $\Delta z \gg \delta x$ and $\Delta z \gg \delta y$.

5. The amusement device of claim 1 wherein said spinning object is cylindrically symmetric.

6. The amusement device of claim 1 wherein said spinning object is cylindrical.

7. The amusement device of claim 1 wherein said upper surface of said base is mirrored.

* * * * *